US010058734B2

(12) United States Patent
Thurman et al.

(10) Patent No.: US 10,058,734 B2
(45) **Date of Patent: *Aug. 28, 2018**

(54) RACQUET HIT NOTIFICATION

(71) Applicant: Wilson Sporting Goods Co., Chicago, IL (US)

(72) Inventors: Robert T. Thurman, Plainfield, IL (US); William D. Severa, Darien, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/432,006

(22) Filed: Feb. 14, 2017

(65) Prior Publication Data

US 2017/0151464 A1 Jun. 1, 2017

Related U.S. Application Data

(63) Continuation of application No. 14/453,837, filed on Aug. 7, 2014, now Pat. No. 9,597,554.

(Continued)

(51) Int. Cl.

*A63B 49/00* (2015.01)
*A63B 49/02* (2015.01)

(Continued)

(52) U.S. Cl.

CPC ..... *A63B 24/0062* (2013.01); *A63B 49/00* (2013.01); *A63B 69/38* (2013.01); *A63B 71/0619* (2013.01); *A63B 2208/0204* (2013.01); *A63B 2220/17* (2013.01); *A63B 2220/80* (2013.01); *A63B 2220/833* (2013.01)

(58) Field of Classification Search

CPC ..... A63B 24/00; A63B 24/0062; A63B 49/00; A63B 51/00; A63B 51/005; A63B 59/00; A63B 69/00; A63B 69/38; A63B 71/06; A63B 71/0619; A63B 71/0622; A63B 71/0625; A63B 71/0694; A63B 2220/17; A63B 2220/40; A63B 2220/50; A63B 2220/51; A63B 2220/53; A63B 2220/833; A63B 2225/50; A63B 2220/80;

(Continued)

(56) References Cited

U.S. PATENT DOCUMENTS 3,897,058 A 7/1975 Koch
4,021,792 A * 5/1977 Ludt ..... G08B 17/103 250/574

(Continued)

*Primary Examiner* — Raleigh W Chiu
(74) *Attorney, Agent, or Firm* — Terence P. O'Brien; Todd A. Rathe

(57) ABSTRACT

An apparatus including a sensor carried by a racquet and an indicator in communication with the sensor. The sensor outputs a notification based on (a) the number of hits by the racquet based on signals from the sensor and (b) at least one of an elapsed time since a last stringing of the racquet and an input skill level of a person using the racquet. Additionally, an apparatus including a racquet, a sensor carried by the racquet, and an indicator in communication with the sensor. The sensor can be a strain gauge, a load cell, an acoustic sensor and a vibro-acoustic sensor. The sensor outputs a notification based on the number of hits by the racquet based on signals from the sensor.

20 Claims, 5 Drawing Sheets

Related U.S. Application Data

(60) Provisional application No. 61/863,178, filed on Aug. 7, 2013.

(51) Int. Cl.
*A63B 69/38* (2006.01)
*A63B 24/00* (2006.01)
*A63B 71/06* (2006.01)

(58) Field of Classification Search
CPC .... A63B 2208/0204; A63B 2071/0625; A63B 2071/063; A63B 2071/0658
See application file for complete search history.

(56) References Cited

U.S. PATENT DOCUMENTS 4,521,807 A * 6/1985 Werson ..... B07C 5/10 348/134
4,759,219 A 7/1988 Cobb et al.
4,822,042 A 4/1989 Landsman
4,870,868 A 10/1989 Gastgeb et al.
4,911,441 A 3/1990 Brunner
4,967,596 A 11/1990 Rilling et al.
5,031,909 A 7/1991 Pecker
5,372,365 A 12/1994 McTeigue et al.
5,646,911 A 7/1997 Davis
5,841,029 A 11/1998 Luking
6,134,965 A 10/2000 Somville
6,173,610 B1 1/2001 Pace
D458,171 S 6/2002 Lin
6,409,616 B1 6/2002 Lin
6,527,655 B2 3/2003 Sims et al.
7,021,140 B2 4/2006 Perkins
7,104,905 B2 9/2006 Schwenger et al.
7,108,617 B2 9/2006 Gorski et al.
7,140,248 B1 11/2006 Brundage
7,234,351 B2 6/2007 Perkins
7,244,050 B2 * 7/2007 Summerford ..... F21V 5/02 362/299
7,326,133 B1 2/2008 Choi
7,445,362 B2 * 11/2008 Compton ..... F21S 8/04 362/147
7,946,734 B2 * 5/2011 Laporte ..... F21S 8/088 362/308
8,449,410 B1 5/2013 Kaufman
8,602,922 B2 12/2013 Schwenger et al.
8,641,239 B2 * 2/2014 Yurich ..... F21S 8/061 313/113
8,903,521 B2 12/2014 Goree et al.
8,905,855 B2 12/2014 Fitzpatrick et al.
8,941,723 B2 1/2015 Bentley et al.
8,944,928 B2 2/2015 Kaps et al.
2002/0007676 A1 1/2002 Ward et al.
2002/0068652 A1 6/2002 Sims et al.
2002/0134153 A1 9/2002 Grenlund
2005/0192129 A1 9/2005 Kuwabara
2005/0197198 A1 9/2005 Otten et al.
2005/0261073 A1 11/2005 Farrington, Jr. et al.
2007/0105664 A1 5/2007 Scheinert et al.
2008/0163697 A1 7/2008 Silpachai et al.
2008/0200287 A1 8/2008 Marty et al.
2010/0279800 A1 11/2010 Zuger
2011/0183787 A1 6/2011 Schwenger et al.
2012/0004055 A1 1/2012 Balasubramanyan
2012/0277890 A1 11/2012 Han
2012/0278023 A1 11/2012 Han
2012/0313534 A1 * 12/2012 Urtiga ..... F21V 5/045 315/158
2013/0298668 A1 11/2013 Sato
2013/0316855 A1 11/2013 Mace
2013/0319113 A1 12/2013 Mizuta
2015/0045153 A1 2/2015 Thurman et al.
2015/0057112 A1 2/2015 Sak et al.
2015/0141175 A1 5/2015 Pisupati et al.
2015/0157901 A1 6/2015 Mace et al.

* cited by examiner

RACQUET HIT NOTIFICATION

CROSS REFERENCE TO RELATED APPLICATION

The present application is a continuation application claiming priority under 35 U.S.C. § 120 from co-pending U.S. patent application Ser. No. 14/453,837 filed on Aug. 7, 2014 by Thurman et al. and entitled RACQUET HIT NOTIFICATION, which claims the benefit of provisional application No. 61/863,178 filed on Aug. 7, 2013, the full disclosure of which is hereby incorporated by reference.

BACKGROUND

Many racquets, such as tennis racquets, utilize a taut string bed to provide a hitting surface. Over time, the tension of the stringing of the string bed declines, impacting performance. Determining when the stringing needs to be replaced or re-strung is difficult and subjective.

DETAILED DESCRIPTION OF THE EXAMPLE EMBODIMENTS

Figure 1:
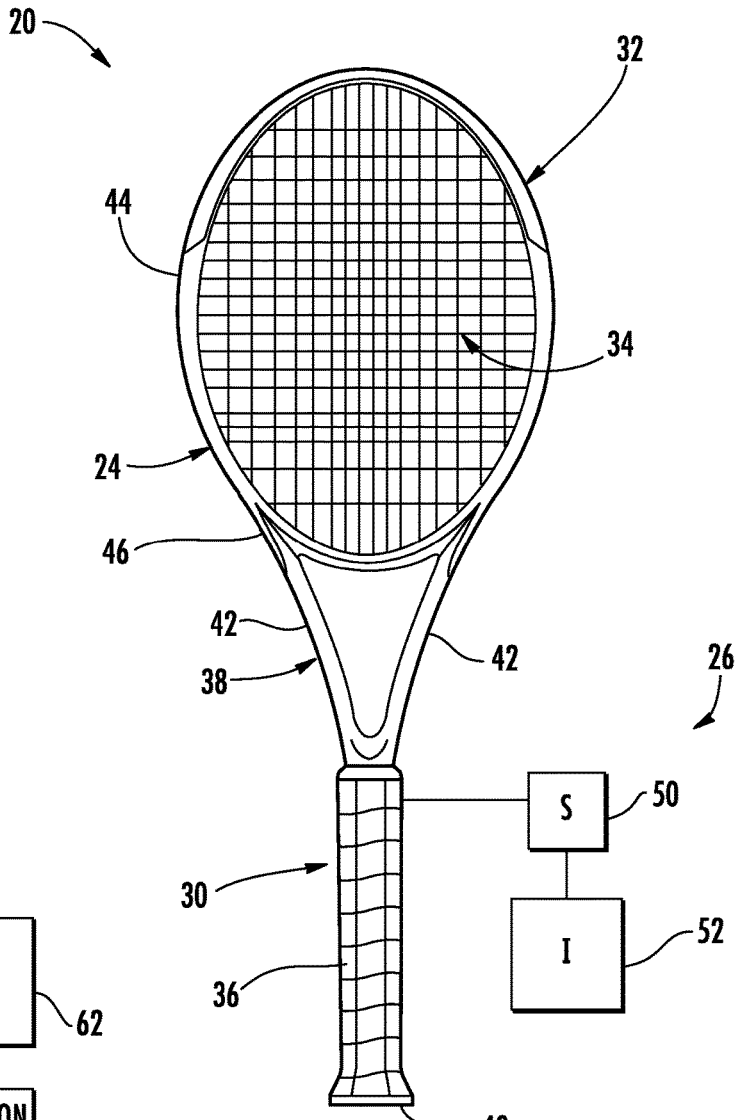
FIG. 1 is a schematic diagram of an example racquet system.

FIG. 1 illustrates an example racquet system 20. As will be described hereafter, racquet system 20 senses impacts against strings of a racquet and outputs a notification based on a number of ball impacts with the stringing. System 20 comprises racquet 24 and hit notification system 26.

Racquet 24 comprises a racquet utilizing strings or stringing held in tension as a hitting surface. In the example illustrated, racquet 24 comprises a tennis racquet. In other implementations, racquet 24 may comprise other forms of racquets for use in other sports such as racquetball racquets, badminton racquets, squash racquets in other racquets that utilize stringing as a hitting surface. Racquet 24 comprises shaft 30, head 32 and stringing 34.

Shaft 30 extends from head 32 and comprises handle 36 and throat 38. Handle 36 terminates at a butt cap 40 at one end and is joined to throat 38 at another end. Handle 36 provides a surface for being gripped by a person during use of racquet 24.

Throat 38 extends from handle 36 to head 24. In the example illustrated, throat 38 comprises a pair of diverging forks 42. In other implementations, throat 38 may comprise a single shaft or bar extending between handle 36 and head 32.

Head 32 extends from throat 38 of shaft 30 and holds or supports stringing 34. Head 32 comprises a frame 44 joined to throat 38 at shoulder 46. Frame 44 supports stringing 34. Stringing 34 comprises a length of string secured to or threaded through openings (or string holes) in frame 44. Stringing 34 forms a plurality of main string segments interlaced with a plurality of cross-string segments. Stringing 34 is secured and maintained in a taut state under tension so as to provide a hitting face are hitting surface for a ball (such as a tennis ball) or other projectile.

Hit notification system 26 senses impacts of the ball or other projectile against stringing 34 of racquet 24 and outputs a notification based on the number of hits or impacts by the racquet. Hit notification system 26 comprises sensor 50 and indicator 52. Sensor 50 comprises one or more sensing devices carried by racquet 24 and configured to sense impacts of a ball or other projectile against stringing 34. In one implementation, sensor 50 senses a sound created during impact of racquet 24 with a ball or projectile. In another implementation, sensor 50 senses a change in motion or acceleration of racquet 24 before, during and/or after impact of racquet 24 with a ball or projectile. In another implementation, sensor 50 senses vibration or forces occurring during impact of racquet 24 with a ball or projectile. In the example illustrated, sensor 50 comprises an accelerometer. In other implementations, sensor 50 may comprise other forms of sensors which produce signals facilitating the detection identification of the impact between stringing 34 and a ball or projectile. In one implementation, sensor 50 can be a vibroacoustic sensor that combines aspects of an accelerometer and a microphone (or audio sensor).

In one implementation, sensor 50 is incorporated into or embedded in an interior portion of racquet 24. For example, in one implementation, sensor 50 is embedded within a hollow interior of frame 44. In another implementation, sensor 50 is embedded within a hollow interior of throat 38. In yet another implementation, sensor 50 is embedded within handle 36.

In another implementation, sensor 50 is mounted, fastened or otherwise secured to an exterior portion of racquet 24. For example, in one implementation, sensor 50 is mounted along an outside edge of frame 44. In another implementation, sensor 50 is mounted along and inside edge of frame 44. In one implementation, sensor 50 is mounted so as to contact stringing 34. In another implementation, sensor 50 is mounted along an interior exterior side, edge or face of throat 38. For example, in one implementation, portions of racquet 24 may include a recess or cavity receiving sensor 50. In one implementation, sensor 50 is secured to racquet 24 during the manufacture of racquet 24. In another implementation, sensor 50 is secured to racquet 24 as an aftermarket accessory.

Indicator 52 communicates with sensor 50 and outputs a notification based upon a number of hits or impacts between racquet 24 and a ball or projectile based upon signals from sensor 50. The notification provided by indicator 52 may comprise a sound, an illumination, one or more alphanumeric characters or symbols and the like. As will be described hereafter with respect to subsequent example implementations, indicator 52 may be entirely carried by racquet 24, may have portions that are carried by racquet 24 and portions that are remote from racquet 24 or maybe entirely remote from racquet 24.

Figure 1A:
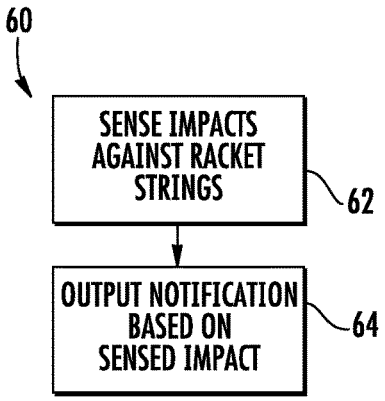
FIG. 1A is a flow diagram of an example method that may be carried out by the racquet system of FIG. 1.

FIG. 1A illustrates an example method 60 and may be carried out by racquet system 20 or other racquet systems described hereafter. As indicated by step 62, sensor 50 senses impacts against racquet strings or stringing 34. As indicated by step 64, indicator 52 outputs a notification based upon the sensed impacts against strings or stringing 34 of racquet 24. Overall, hit notification system 26 provides a notification based upon a number of hits or impacts between racquet 24 and a ball or projectile. This notification facilitates the determination of the wear or extent of use of stringing 34, indicating when stringing 34 should be replaced or restrung.

Figures 2, 3:
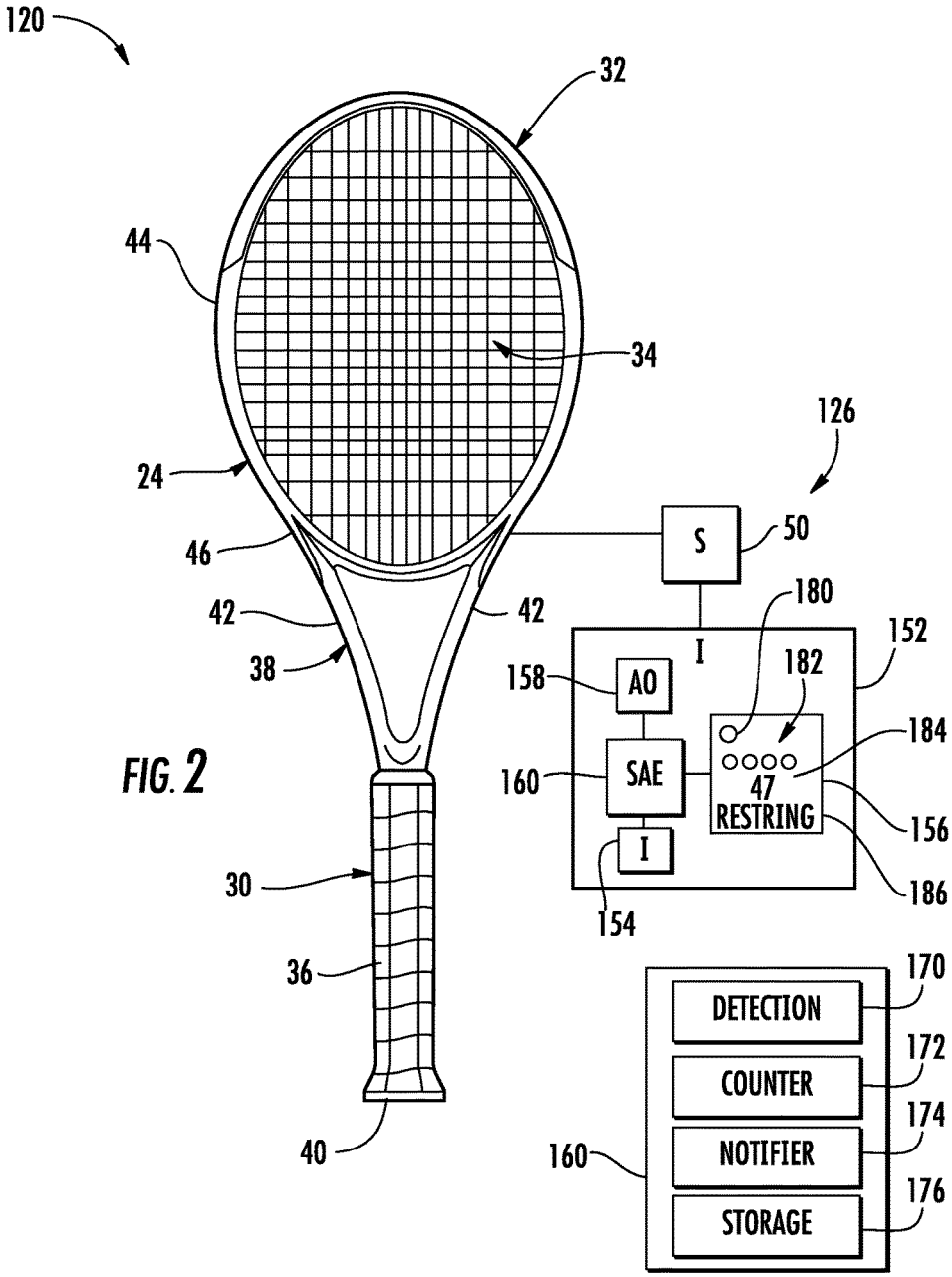
FIG. 2 is a schematic diagram of another example racquet system.
FIG. 3 is a schematic diagram of an example signal analyzing electronics.

FIG. 2 illustrates racquet system 120, a particular implementation of racquet system 20. Racquet system 120 is similar to racquet system 20 except that racquet system 120 is specifically illustrated as comprising hit notification system 126, a particular implementation of hit notification system 26. Those remaining components of racquet system 120 correspond to components of racquet system 20 are numbered similarly.

As with hit notification system 26, hit notification system 126 senses impacts of the ball or other projectile against stringing 34 of racquet 24 and outputs a notification based on the number of hits or impacts by the racquet. Hit notification system 126 comprises a sensor 50 (described above) and indicator 152, an example implementation of indicator 52. Indicator 152 is carried by racquet 24. In one implementation, indicator 152 is embedded or incorporated into or as part of racquet 24. In another implementation, indicator 152 is releasably fixed or mounted to racquet 24 in a fashion similar to the attachment of sensor 50 to racquet 24 as described above.

Indicator 152 communicates with sensor 50 and outputs a notification based upon a number of hits or impacts between racquet 24 and a ball or projectile based upon signals from sensor 50. Indicator 152 comprises input 154, visual notification output 156, audible notification output 158 and signal analyzing electronics 160. Input 154 comprises one or more devices by which a person may enter data, make selections or enter commands for hit notification system 126. For example, in one implementation, input 154 may allow a person to select one of various modes by which a notification is presented, whether visual through visual notification output 156 or whether audible through audible notification output 158. Input 154 may allow a person to select one of various visual notification modes. In one implementation, input 154 may allow a person, such as a racquet stringer, to reset hit notification system 126 to a zero hit count value when stringing 34 is restrung or replaced.

In one implementation, input 154 may allow a person to enter customizable thresholds for when notifications are provided such as when restringing is suggested by notification system 126. For example, one person may prefer to be notified that restringing should be performed when performance is even slightly impacted by the lessening of tension of stringing 34. Another person may have greater tolerances for performance degradation, preferring to receive a notification for restringing at a later time when performance is even more impacted by the lessening of tension of stringing 34.

In one implementation, input 154 may further allow a person to input data or information regarding characteristics of racquet 24 such as characteristics of frame 44 or characteristics of stringing 34. Examples of such characteristics include, but are not limited to, the initial tension of stringing 34, the manufacturer's recommended tension or range of tensions restringing 34, the gauge of stringing 34, the density of stringing 34, the material or type of stringing 34, the material of frame 44 and/or handle 36 and/or handle 36 of racquet 24. Such additional characteristics may be used by signal analyzer electronics 160 to more accurately identify hits or impacts to more accurately or reliably provide notifications based upon the identified number of hits or impacts.

In one implementation, input 154 may further allow a person to enter playing conditions, skill levels and/or racquet performance preferences. For example, input 154 may allow a person/player to enter his or her skill level. A player with a greater skill level may hit a ball or projectile with a greater force or velocity such that the tension of stringing 34 may decline at a greater rate as compared to a player with a lower level of skill who hits a ball or projectile at a lesser force or velocity. Input 154 may additionally or alternatively allow a person/player to enter his or her racquet performance preferences. For example, a first player may prefer lesser string tension while a second player may prefer greater string tension depending upon the player's preferences for ball control, feel, responsiveness and other performance characteristics that depend upon the tension of stringing 34. Based on such inputs, signal analyzer electronics 160 may adjust its determination of when an impact occurs as well as when or how notifications are provided.

In one implementation, input 154 comprises a button, toggle switch, slider bar or other device by which data, instructions or commands may be manually entered. In yet another implementation, input 154 may comprise a microphone with associated speech recognition electronics built into racquet 24. In yet another implementation, input 154 may comprise an RFID reader, an optical scanner or other devices configured to sense or read an external RFID tag, bar code or the like indicating notification settings or preferences that are to be used by notification system 126. Overall, input 154 allows notification system 126 to be customized for a particular player's playing style, skill level and preferences as well as specific characteristics of the particular racquet 24 in which notification system 126 is employed. In yet other implementations, input 154 may be omitted, wherein such notification thresholds and settings are preprogrammed or otherwise pre-established for use by signal analyzing electronics 160 at the point of manufacture or attachment to racquet 24.

Visual notification output 156 comprises one or more devices by which notifications may be visually presented to a person/player. In one implementation, output 156 comprises a display screen such as in LED screen, organic light emitting diode screen or other screen technology. In another implementation, output 156 comprises a single light emitter, such as the light emitting diode, or a series or array of light emitters. Audio notification output 158 comprises a speaker or other device by which sound is generated to provide a notification from hit notification system 126. Although indicator 152 is illustrated as including both a visual notification output 156 and an audible notification output 158, some implementations, one of such notification outputs may be omitted.

Signal analyzing electronics 160 comprises electronics configured to receive signals from sensor 50, to determine or identify hits or impacts based upon such signals and to provide a notification based upon such determined hits or impacts using one or both of outputs 156, 158. For purposes of this disclosure, the term "electronics" means any combination of hardware, firmware, software/programming and the like facilitating the analysis of signals, identification of hits and provision of a notification based upon such hits. For example, in one implementation, signal analyzing electronics 160 may comprise one or more application-specific integrated circuits. In another implementation, signal analyzing electronics 160 may comprise one or more processing units and associated non-transient or non-transitory computer-readable mediums or persistent storage devices containing computer-readable instructions, programming or software code for directing the processing unit(s) to carry out the noted functions.

FIG. 3 schematically illustrates signal analyzing electronics 160 in more detail. As shown by FIG. 3, signal analyzer electronics 160 comprises several modules for carrying out different functions. Such modules may be implemented in different integrated circuits or different memory stored programming or code portions. In the example illustrated, signal analyzer electronics 160 comprises detection module 170, counter module 172 and notifier module 174. Detection module 170 utilizes signals from sensor 52 detector identify impacts of a ball or projectile against stringing 34. In one implementation, detection module 170 may utilize one or more filters or threshold values to remove or discount signal noise for enhanced accuracy.

Counter module 170 receives signals from detection module 170 indicating a determined or deemed impact. Counter module 170 counts or tracks the number of impacts over time. When stringing 34 is replaced or restrung, counter 172 automatically or in response use input through input 154 is returned to a zero count value. In one implementation, counter module 170 comprises a digital counter. In another implementation, counter module 170 stores the current count value in memory or storage 176.

Notifier module 174 receive signals from counter 172 indicating a current count of the number of impacts and generates or otherwise produces control signals causing outputs 156, 158 to output a notification based on the number of hits by the racquet. In one implementation, notifier module 174 output such notifications based upon settings stored in storage 176. As described above with respect input 154, such settings may be based on various inputs such as characteristics of racquet 24, characteristics of the expected level or conditions of play of racquet 24 as well as player preferences.

FIG. 2 illustrates four example modes for outputting a notification based on the number of hits by the racquet. In a first mode, notifier module 174 utilizes an individual light emitter 180 to provide a visible notification. Light emitter 180 may comprise a light emitting diode, a lightbulb or other light emitting element. Light emitter 180 may comprise a portion of a display screen, such as a graphic presented on the display screen, that is illuminated. Notifier module 174 adjusts one or more of an illumination color, an illumination brightness and an illumination frequency based upon the current count for the number of hits upon stringing 34. For example, in one implementation, light emitter 180 may "turn on" and begin illuminating when the number of impacts or hits exceeds a predefined threshold such that restringing is recommended. As the need for restringing increases or as the number of hits exceeds subsequent greater thresholds, notifier module 174 may further adjust the frequency, brightness or color of light being illuminated by light emitter 180. For example, notifier module 174 may change the color from green to yellow to red as a number of hits pass certain thresholds. Notifier module 174 may additionally or alternatively increase the frequency of flashes of light emitter 180 as a number of hits pass certain thresholds. Notifier module 174 may additionally or alternatively increase a brightness of light being provided by light emitter 180 as a number of hits pass certain thresholds.

In a second mode, notifier module 174 utilizes an array or series 182 of individual light emitters to provide a visible notification. As with light emitter 180, a series 182 of individual light emitters may comprise individual light emitting diodes, individual light emitting balls or individual portions or graphics on a display screen. In this second mode, notifier module 174 selectively illuminates individual light emitters of the series 182 to indicate the number of hits or when restringing is suggested. For example, when a first threshold for the number of hits has been met, notifier module 174 may illuminate a first individual light emitter of the series 182. When a second threshold for the number of hits has been met, notifier module 174 may illuminate a second individual light emitter of the series 182. In one implementation, the first individual light emitter of the series previously lit his continued to be lit while the second individual light emitter is illuminated. In another implementation, the illumination of the first individual light emitter is terminated when the second individual light emitter is illuminated. In the second mode, the number of light emitters that are illuminated indicates a number of hits or the number of thresholds have been met. In one implementation, notifier module 174 may additionally adjust one or more of the color, brightness and/or frequency at which the light emitters of the series 182 are illuminated to provide additional information. For example, different individual light emitters of the series 182 may be illuminated with different colors, different brightness or different frequencies. In one implementation, the first light emitter of series 182 may be green, the second light emitter of series 182 may be yellow of the third light emitter of series 182 may be red, wherein the red color indicates an urgent need for restringing.

In a third mode, notifier module 174 utilizes one or more alphanumeric characters or symbols to provide an actual hit count 184. The hit count may be provided on a display screen or with other display technologies. In one implementation, notifier module 174 may additionally adjust one or more of the color, brightness and/or frequency of the displayed hit count 184 to provide additional information. For example, the hit count 184 may be presented with different colors, different brightness or different frequencies. In one implementation, the hit count 184 may initially be green. After the hit count exceeds a first threshold indicating that stringing 34 may be restrung, the displayed hit count 184 may be changed to a yellow color. After the hit count exceeds a second greater threshold or strongly indicating that stringing 34 should be restrung, the displayed hit count 184 may be presented in a red color. Similar adjustments may be made additionally or alternatively employing brightness levels or flash frequencies.

In a fourth mode, notifier module 174 utilizes one or more alphanumeric characters or symbols to provide a restringing recommendation status 186. The restringing recommendation status may be provided on a display screen or with other display technologies. In one implementation, notifier module 174 may additionally adjust one or more of the color, brightness and/or frequency of the displayed restringing recommendation status 186 to provide additional information. For example, the restringing recommendation status 186 may be presented with different colors, different brightness or different frequencies. In one implementation, the restringing recommendation status 186 may be a displayed "OK" or other numerical character or text in green. After the hit count exceeds a first threshold indicating that stringing 34 may be restrung, the displayed status 186 may be changed to a "restring" message in a yellow color. After the hit count exceeds a second greater threshold or strongly indicating that stringing 34 should be restrung, the displayed status 186 of "restring" may be presented in a red color. Similar adjustments may be made additionally or alternatively employing brightness levels or flash frequencies. In one implementation, a person/player may select one of the example four notification modes. In one implementation, a person/player may select more than one of the four notification modes. In yet other implementations, hit notification system 126 may employ additional or alternative notification modes.

Although not illustrated, hit notification system 126 is powered by an internal battery. The internal battery may comprise an insertable or replaceable battery, such as a button cell battery. In one implementation, the internal battery is rechargeable through inductive recharging or through a plug-in port. In one implementation, the internal battery is rechargeable using one or more solar cells provided along an exterior of racquet 24. In another implementation, an energy harvesting module may be incorporated into racquet 24 and used to maintain or recharge the battery. In another implementation, the hit notification system 26 can be passive in nature and not require a separate battery, rechargeable battery or other remote power source. In one implementation, the notification system 26 can incorporate passive RFID technology.

Figure 4:
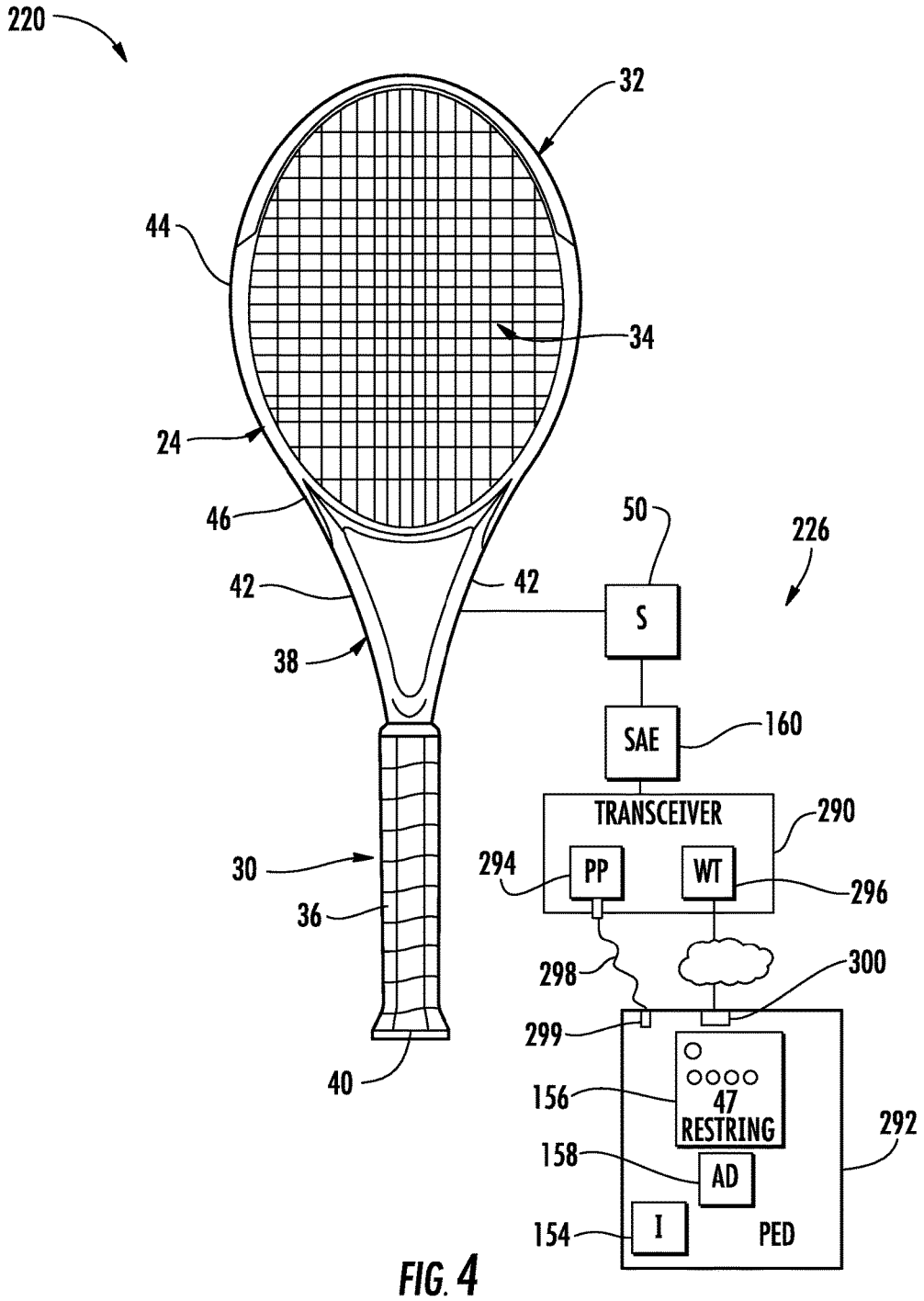
FIG. 4 is a schematic diagram of another example racquet system.

FIG. 4 illustrates racquet system 220, another example implementation of racquet system 20. Racquet system 220 is similar to racquet system 20 except that racquet system 220 comprises hit notification system 226 in place of hit notification system 26. Hit notification system 226 is itself similar to hit notification system 126 (shown and described with respect to FIG. 3) except that it notification system 226 additionally comprises transceiver 290 and portable electronic device 292.

Transceiver 290 comprises a device carried by racquet 24 that is configured to facilitate communication between signal analyzer electronics 160 (carried by racquet 24) and portable electronic device 292. In the example illustrated, transceiver 290 offers two modes of communication. Transceiver 290 comprises plug-in port 294 and wireless transceiver 296. Plug-in port 294 comprises a port by which a communication cable 298 extending between plug-in port 294 and portable electronic device 292 may be connected in a wired fashion. In one implementation, plug-in port 294 comprises a universal serial bus (USB) type port. In yet another implementation, plug-in port 294 may comprise other forms of communication ports by which data may be transmitted. In one implementation, power may be further provided through plug-in port 294 to recharge an internal battery of racquet 24.

Wireless transceiver 296 comprises a device by which data may be communicated in a wireless fashion between portable electronic device 292 and transceiver 290. In one implementation, wireless transceiver 296 comprises a Bluetooth device. In another implementation, wireless transceiver 296 comprises a Wi-Fi or other radiofrequency transmitter. In another implementation, wireless transceiver 296 comprises an active read/write RFID tag which is written upon with data sensed by sensor 28, wherein wireless transceiver 296 actively transmits signals from the tag. In another implementation, wireless transceiver 296 comprises an infrared or other optical communication device. In yet other implementations, wireless transceiver 296 may comprise other devices that communicate in a wireless fashion. In one implementation, transceiver 290 may omit one of plug-in port 294 and wireless transceiver 296.

Portable electronic device 292 comprises a device configured to receive signals output from transceiver 290 and to output a notification based upon the number of determined hits or impacts. In the example illustrated, portable electronic device 292 comprises input 154, visual notification output 156 and audible notification output 158 (as described above). Portable electronic device 292 is configured to communicate with transceiver either plug-in port 294 or wireless transceiver 296 through plug-in port 299 or wireless transceiver 300. Examples of portable electronic device 292 include, but are not limited to, a smart phone, a flash memory reader (IPOD), a cell phone, a personal data assistant, a laptop computer, a tablet computer, a netbook computer, a wrist-top computer and the like. In one implementation, portable electronic device tonight to may be configured similar to or provided as part of a wristwatch, wristband or other wearable device, permitting a player or user to view notifications while on a court in real time. In yet another implementation, portable electronic device to 292 may be configured similar to or provided as part of a pair of glasses or other eyewear, permitting a player or user to view notifications while on the court in real time.

In operation, sensor 50 generates or produces electronic signals (or optical signals) in response to a ball or other projectiles impacting with stringing 34. Signal analyzer electronics 160 receive such signals and detection module 170 detects or determines impacts which are counted by counter module 172. The counted number of impacts are received by notifier module 174 which transmits data are control signals in a wired or wireless fashion to portable electronic device 292 where an appropriate notification (if warranted) is presented on portable electronic device 292 through either output 156 or output 158. Various settings for use by notifier module 174 or input through input 154 of portable electronic device 292 and are transmitted to signal analyzing electronics 160 in a wired or wireless fashion. In another implementation, notifier module 174 is alternatively incorporated as part of portable electronic device 292, wherein the counted number of impacts determined by counter module 172 are transmitted in a wired or wireless fashion to portable electronic device 292. In yet another implementation, counter module 172 and notifier module 174 are incorporated as part of portable electronic device 292, wherein detection module 170, incorporate part of racquet 24, detects impacts using signals from sensor 50 and communicates the detected impacts in a wired or wireless fashion to portable electronic device 292, where portable electronic device 292 counts and tracks such impacts and determines when and how a notification is presented using modules 172 and 174.

Figure 5:
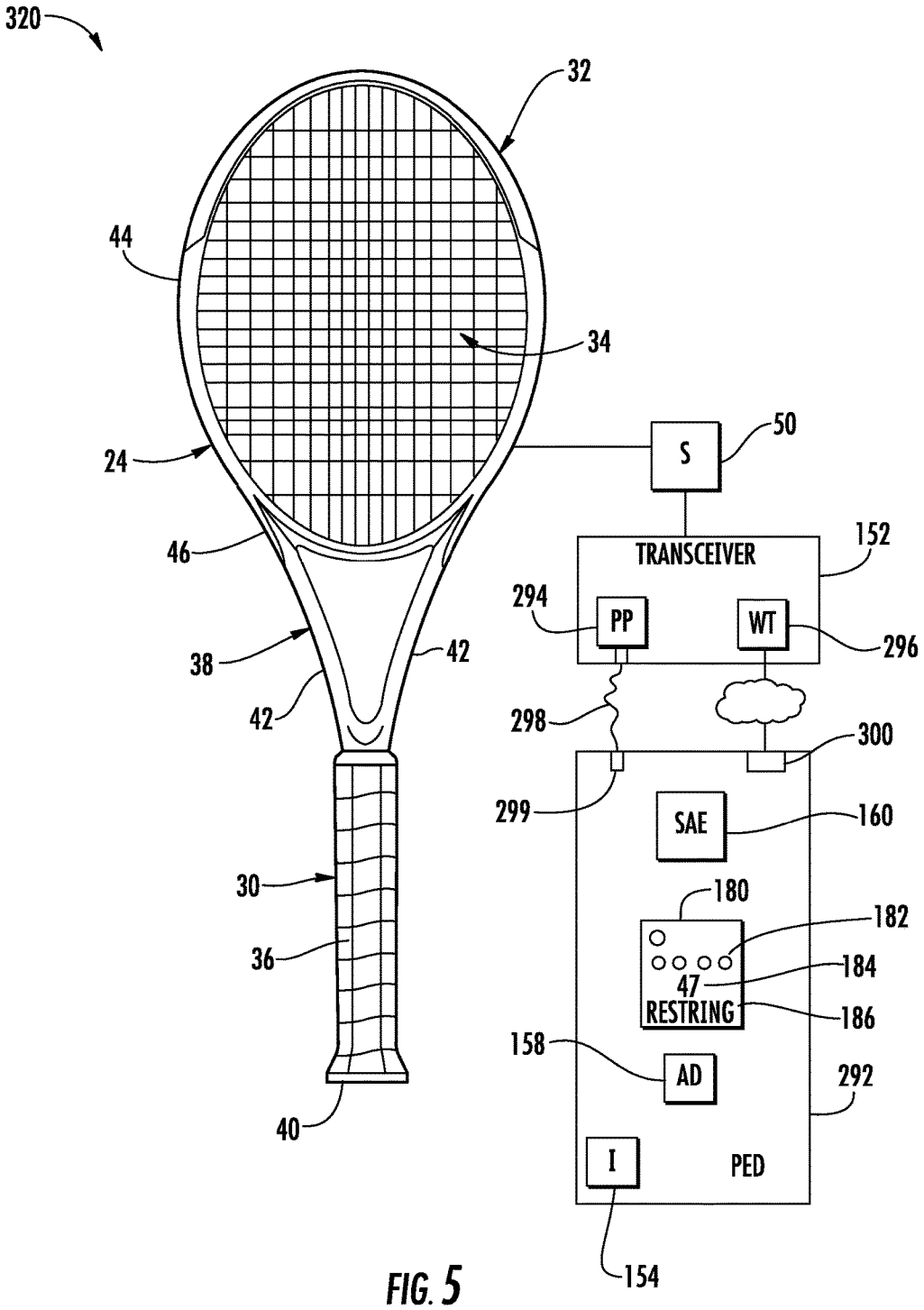
FIG. 5 is a schematic diagram of another example racquet system.

FIG. 5 illustrates racquet system 320, another example implementation of racquet system 20. Racquet system 320 is similar to racquet system 220 except that signal analyzing electronics 160 are entirely incorporated as part of portable electronic device 292. In racquet system 320, signals from sensor 50 presumably resulting from impacts with stringing 34, are directly sent to portable electronic device 292 by transceiver 152 in a wired or wireless fashion. Signal analyzer electronics 160 of portable electronic device 292 receive such signals and determine or identify impacts (using detection module 170), count the number of impacts (using counter module 172) and output a notification on output 156 and/or output 158 (using notifier module 174).

Figure 6:
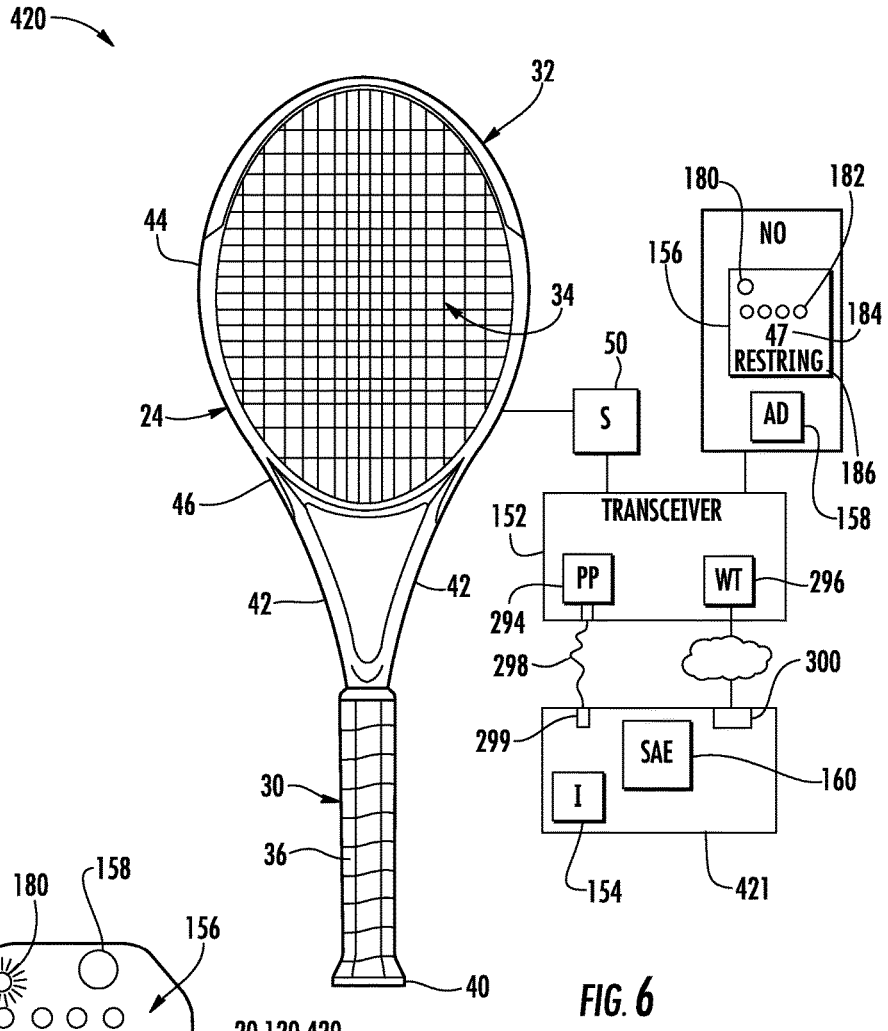
FIG. 6 is a schematic diagram of another example racquet system.

FIG. 6 illustrates racquet system 420, another example implementation of racquet system 20. Racquet system 420 is similar to racquet system 320 except that notification outputs 156, 158 are incorporated into and carried by racquet 24, wherein signal analyzing electronics 160 remain remote from racquet 24. In operation, sensor 50 generates or produces electronic signals (or optical signals) in response to a ball or other projectiles impacting with stringing 34. Signals from sensor 50 presumably resulting from impacts with stringing 34, are directly sent to a remote signal analyzer 421 by transceiver 152 in a wired or wireless fashion. Signal analyzer electronics 160, provided at the remote signal analyzer 421, receives such signals and determine or identify impacts (using detection module 170) and count the number of impacts (using counter module 172). The counted number of impacts are received by notifier module 174 which transmits data or control signals in a wired or wireless fashion to at least one of notification outputs 156, 158 where an appropriate notification (if warranted) is presented using either output 156 or output 158. Various settings for use by notifier module 174 are input through input 154 remote from racquet 24.

In one implementation, remote signal analyzer 421 comprises a portable electronic device similar to portable electronic device 292. In such an implementation, both the portable electronic device forming remote signal analyzer 421 and racquet 24 comprise at least one of outputs 156, 158, wherein notification may be provided on one or both of the portable electronic device and racquet 24. In another implementation, remote signal analyzer 421 comprises a computing device that is not readily portable, such as a desktop computer or a remote server computer. In one implementation, the remote server computer may additionally be configured to provide notifications based on the number of hits by the racquet based on signals from sensor 50 on a website. In such an implementation where such notifications are accessible on a website, racquet 24 may omit notification outputs 156 and/or 158. In yet other implementations, portions of signal analyzing electronics 160 may be incorporated into or provided as part of racquet 24 while other portions of signal analyzing electronics 160 are provided on a remote computing device or remote server. In yet other implementations, portable electronic device 292 of racquet systems 220, 320 may alternatively comprise a non-portable computing device, such as a remote computer server, wherein notification outputs 156, 158 are presented on a local area network or wide area network (Internet) webpage. For example, signal analysis and notifications may be carried out and provided in a cloud computing based environment.

Figure 7:
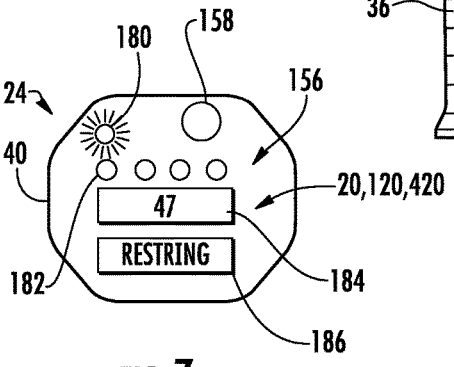
FIG. 7 is an end view of an example racquet including example notification outputs.

FIG. 7 illustrates one example implementation of notification outputs 156, 158. As shown by FIG. 7, in one implementation, visual notification output 156 and audible notification output 158 are located in the butt cap 40 of racquet 24. As a result, output 156, 158 do not detract from the in play use of racquet 24. At the same time, such notifications are readily discernible by a person/player. In such an implementation, signal analyzing electronics 160 (described above) may be incorporated into the interior of handle 36 where such electronic or less susceptible to shock and vibration and where adequate space exists for such electronics without altering the configuration of racquet 24.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. For example, the implementations discussed above can be used for monitoring other racquet characteristics, such as swing speed, racquet position, etc. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a sensor to be carried by a racquet; and an indicator in communication with the sensor to output a notification based on (a) the number of hits by the racquet based on signals from the sensor and (b) at least one of an elapsed time since a last stringing of the racquet and an input skill level of a person using the racquet.

2. The apparatus of claim 1, wherein the indicator comprises:

sensor signal analyzing electronics to be carried by the racquet; and a notification output to be carried by the racquet to provide the notification.

3. The apparatus of claim 2, wherein the notification provided by the notification output is a visible notification.

4. The apparatus of claim 3, wherein the visible notification comprises an estimated number of hits by the racquet.

5. The apparatus of claim 3, wherein the visible notification comprises a recommendation for restringing the racquet.

6. The apparatus of claim 3, wherein the visible notification is on a handle butt of the racquet.

7. The apparatus of claim 2, wherein the notification provided by the notification output is an audible notification.

8. The apparatus of claim 1, the sensor comprises a vibroacoustic sensor.

9. The apparatus of claim 1, wherein the indicator comprises a counter to be carried by the racquet and in communication with the sensor.

10. The apparatus of claim 9, wherein the indicator further comprises a memory to be carried by the racquet to store a counted number of hits by the counter.

11. The apparatus of claim 1, wherein the indicator comprises:

sensor signal analyzing electronics to be carried by the racquet to produce data based on signals from the sensor;

a transmitter to be carried by the racquet to output the data to electronics remote from the racquet.

12. The apparatus of claim 11, wherein the indicator further comprises a notification output remote from the racquet to output the notification based on the data.

13. The apparatus of claim 1, wherein the indicator comprises:

a transmitter to be carried by the racquet to output signals from the sensor; and a portable electronic device remote from the racquet, the portable electronic device comprising:

a transceiver to receive the signals from the transmitter;

signal analyzing electronics to analyze signals to produce data; and a notification output to output the notification based on the data.

14. The apparatus of claim 1 further comprising:

an input;

signal analyzer electronics to receive at least one input racquet characteristic via the input and selected from a group of characteristics consisting of: initial string tension; manufacturer's recommended tension or range of tensions; strain gauge, string density, material or type of stringing, head size, and tennis racket hoop material, wherein the signal analyzing electronics is to identify hits by the racquet additionally based upon the at least one input racquet characteristic.

15. An apparatus comprising:

a racquet;

a sensor carried by the racquet, the sensor selected from a group of sensors consisting of: a strain gauge, a load cell, an acoustic sensor and a vibro-acoustic sensor; and an indicator in communication with the sensor to output a notification based on the number of hits by the racquet based on signals from the sensor.

16. The apparatus of claim 15, wherein the indicator comprises:

sensor signal analyzing electronics carried by the racquet; and a notification output carried by the racquet to provide the notification.

17. The apparatus of claim 15 further comprising:

an input;

signal analyzer electronics to receive at least one input racquet characteristic via the input and selected from a group of characteristics consisting of: initial string tension; manufacturer's recommended tension or range of tensions; strain gauge, string density, material or type of stringing, head size, and tennis racket hoop material, wherein the signal analyzing electronics is to identify hits by the racquet additionally based upon the at least one input racquet characteristic.

18. The apparatus of claim 15 further comprising an input for entry of an identification of a string of the racquet, wherein the indicator is to output the notification additionally based on the entered identification of the string of the racquet.

19. The apparatus of claim 15 further comprising:

a battery carried by the racquet; and an energy harvesting module incorporated into the racquet to maintain or recharge the battery.

20. The apparatus of claim 15 further comprising an input by which a string characteristic may be entered; and logic to adjust a threshold at which the indicator outputs the notification based upon the entered string characteristic.

* * * * *